United States Patent [19]

Theilacker et al.

[11] Patent Number: 4,827,842

[45] Date of Patent: May 9, 1989

[54] ROTARY OFFSET PRINTING MACHINE SYSTEM WITH REGISTRATION CONTROL

[75] Inventors: Klaus Theilacker, Friedberg; Johann Meitinger, Augsburg-Inningen, both of Fed. Rep. of Germany

[73] Assignee: Man Roland Druckmaschinen AG, Offenbach am Main, Fed. Rep. of Germany

[21] Appl. No.: 137,245

[22] Filed: Dec. 23, 1987

[30] Foreign Application Priority Data

Dec. 24, 1986 [DE] Fed. Rep. of Germany ..... 3644445

[51] Int. Cl.[4] ..... B41F 5/18

[52] U.S. Cl. ..... 101/177; 101/221; 101/248

[58] Field of Search ..... 101/181, 182, 178, 221, 101/177, 179, 180, 142, 143, 248

[56] References Cited

U.S. PATENT DOCUMENTS

| | | | |
|---|---|---|---|
| 3,717,092 | 2/1973 | Crum | 101/248 |
| 3,793,899 | 2/1974 | Bourbonnaud | 101/248 |
| 4,346,656 | 8/1982 | Schwaab | 101/181 |
| 4,696,229 | 9/1987 | Bezler | 101/177 |

FOREIGN PATENT DOCUMENTS 415380 6/1925 Fed. Rep. of Germany .

2844418 4/1980 Fed. Rep. of Germany .

*Primary Examiner*—J. Reed Fisher

*Attorney, Agent, or Firm*—Frishauf, Holtz, Goodman & Woodward

[57] ABSTRACT

To permit exchange of printed subject matter carried on a plate of a plate cylinder (10, 16) of two printing couples (8, 10; 12, 16) which are selectively engageable with an impression cylinder (4) which, for example, can be a blanket cylinder of another printing couple (3, 4), while continuing to print information from one of the plates (10, 16) of a selected one of the first two printing couples, clutches (9, 15) are provided to engage the respective printing couples through drive gears mounted on the shafts of the respective blanket cylinders (6, 12); circumferential register of the associated plate cylinders (10, 16) is obtained by axial shifting of the blanket cylinders (6, 12) and use of spiral gears in which the gears connecting the blanket cylinder and plate cylinder (6, 10; 12, 16) of one printing couple have opposite direction of gear inclination to the drive gear (7, 13) selectively engageable with the main machine drive, for example through a gear (5) on the impression cylinder (4) which, in turn, is coupled to the main drive gear (1). Thus, the gearing which is present to drive the printing couples can, likewise, be used to control respective circumferential register thereof.

11 Claims, 2 Drawing Sheets

ROTARY OFFSET PRINTING MACHINE SYSTEM WITH REGISTRATION CONTROL

REFERENCE TO RELATED PUBLICATIONS

German Pat. No. 28 44 418, to which U.S. Pat. No. 4,346,656, Schwaab, corresponds et al.

German Pat. No. 415,380, assigned to a predecessor company of the present application.

The present invention relates to a rotary offset printing machine system, and more particularly to such a machine system in which multiple printing couples of plate cylinder-blanket cylinder combinations are used, and in which the system is so arranged that one of the plate cylinder couples can be stopped while the others continue to print, so that the plate of one of the plate cylinder couples can be exchanged for another one, for example to print late news on a newspaper. The invention is particularly directed to setting the circumferential register of the plate cylinder in such a system.

BACKGROUND

Printing machine systems in which a printing couple can be stopped while another printing couple continues to operate usually are so arranged that a specific printing couple is used to print a continuous, unchanged text, while another one is used in which exchange of the plate is possible. At least two, alternately connectable printing couples are required if a change in the text to be printed is desired. This permits preparing one plate cylinder, which has just been discontinued or stopped, with a plate for the subsequent, changed text, whereas the other couple continues to print the desired text. Clutches permitting alternate operation of the printing couples for a system of this type are well known in the industry and described, for example, in U.S. Pat. No. 4,346,656, to which No. 28 44 418, corresponds.

It is necessary that the plate cylinder and all apparatus coupled thereto print with proper circumferential as well as lateral register and, therefore, it is customary to provide arrangements for circumferential and lateral register of the plate cylinders. The clutch arrangement of the U.S. Pat. No. 4,346,656 does not, however, concern itself with register adjustment arrangements.

In order to control register, it has been known for many years to shift the circumferential position of one cylinder with respect to another by engaging spiral gears coupled to the respective cylinders, and axially shifting the respective cylinders relative to each other, see for example German Pat. No. 415,380, assigned to a predecessor company of the applicant of the present application, and published in 1925. In order to maintain the register of such coupled cylinders, the cylinders are supplied with special register control gears which, however, are not used to drive the respective cylinders; they are only to maintain circumferential relative position.

THE INVENTION

It is an object to provide a printing system having selectively connectable printing couples so that selected plate cylinders can be disabled, and the printing content thereof changed, and in which the circumferential register can be easily carried out, with minimum equipment, and permitting retrofitting of existing installations.

Briefly, a blanket cylinder of a selectively driven or stopped printing couple can be selectively engaged by a clutch with a drive gear. The blanket cylinder is axially shiftable. Gear means are provided coupling the blanket cylinder and the associated plate cylinder and, upon axial shifting of the blanket cylinder, thereby adjusting the circumferential register of the plate cylinder of the selectively driven printing couple upon selective engagement of the respective clutch.

The system has the advantage that the gears which are present already to drive the printed couples can be used, additionally, for controlling or adjusting the register, by axial shifting, not of the plate cylinder as such, but rather of the shaft carrying the blanket cylinder, thereby also controlling the circumferential register of the plate cylinder. The gears driving the respective cylinders are spiral gears and the system thus results in an inexpensive solution to a circumferential register arrangement problem which, furthermore, easily permits application to already existing machines by making use of the dual function assigned to the gears in accordance with the present invention—transmission of drive power, and adjustment of register by axial shift of the blanket cylinder.

DRAWINGS

FIG. 1 is a schematic side view of a cylinder configuration of the printing system in accordance with the present invention, in which all elements not necessary for an understanding of the present invention have been omitted; and FIG. 2 is a perspective view of the drive side of the printing system in accordance with the present invention.

DETAILED DESCRIPTION

Figure 1:
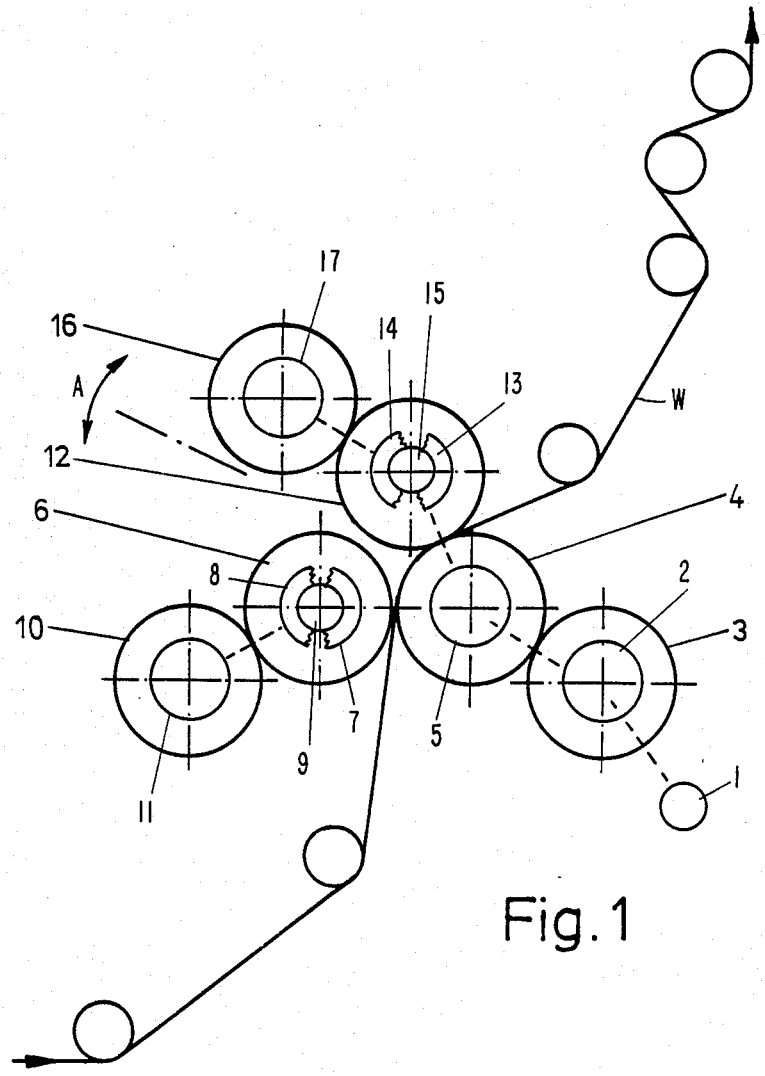

The invention will be described in connection with a six-cylinder system of a rotary offset printing machine. A main gear 1 (FIG. 3) is driven from the main machine drive in any suitable manner. The gear or pinion 1 is in driving engagement with a gear 2 which is securely connected to the end of a shaft of a plate cylinder 3. In FIG. 1, the gears are shown smaller than the respective cylinders for ease of illustration; the gears typically have a pitch diameter which corresponds to the circumference of the cylinders. The respective engagement connections of the gears are shown by broken lines in FIG. 1.

A gear 5, secured to the shaft end of a blanket cylinder 4 is in engagement with the gear 2 of the plate cylinder 3. Blanket cylinder 4 and plate cylinder 3, together, form a first printing couple. Inkers and dampers, customarily used, have been omitted from the drawings for clarity.

All gears and pinions are spiral gears, and, of course, the respective gear teeth which are in engagement with each other have spiral angles which extend in opposite directions.

Figure 2:
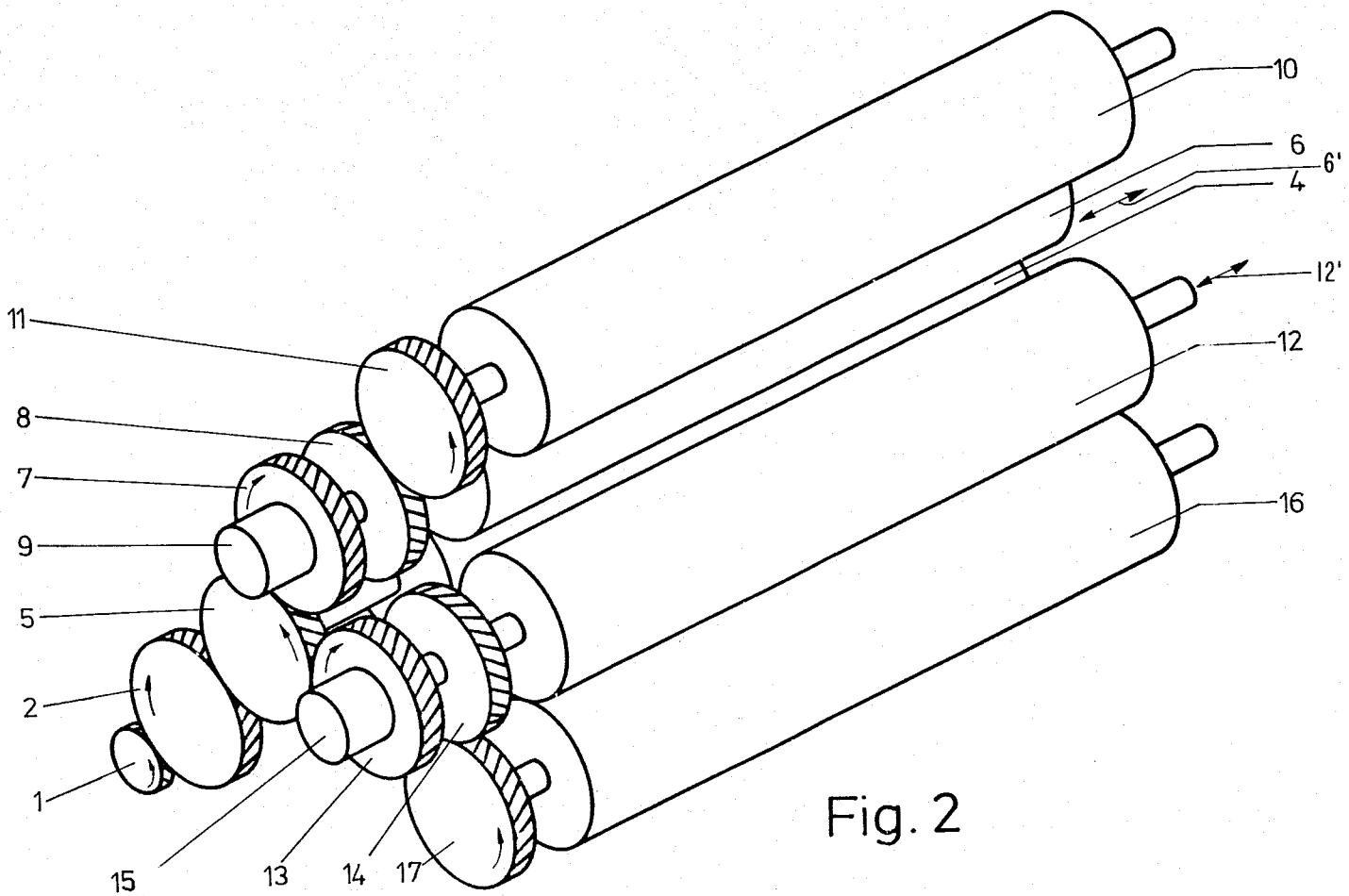

A freely rotatable gear 7 is located on a shaft end of a blanket cylinder 6. The same shaft end of the blanket cylinder 6 has a further gear 8 located thereon. The spiral angle of gear 7 is opposite to that of the gear 8. A clutch 9, shown again schematically in FIG. 1, is located at the free end portion of the shaft of the blanket cylinder 6. The arrangement is best seen in FIG. 2. The clutch 9 permits precise coupling of the shaft of the blanket cylinder 6 with the gear 7, that is, a precise circumferential position of the gear 7 with respect to the circumference of the blanket cylinder 6. A gear 11 on plate cylinder 10 is in fixed engagement with the gear 8 on the shaft end of the blanket cylinder 6. Plate cylinder 10 and blanket cylinder 6, together, with suitable inkers and dampers which are not shown in the drawings for clarity, form a second printing couple.

Gear 5 on the blanket cylinder 4 is coupled to a gear 13 freely rotatable on the shaft of a third blanket cylinder 12. The shaft end of the blanket cylinder 12 has a gear 14 securely connected thereto which has spiral gear angles opposite those of the gear 13. A clutch 15 is located on the shaft end of the blanket cylinder 12 which permits coupling of the blanket cylinder 12 and the gear 13 with precise relative circumferential position. A gear 17, secured to the shaft end of cylinder 16, is in engagement with gear 14. Plate cylinder 16 and blanket cylinder 12, together with suitable dampers and inkers, form a third printing couple.

The first printing couple formed by plate 3 and blanket 4 are provided for continuous printing; the second and third printing couples formed by plates 10 and 6 and 16 and 12, respectively, can be engaged alternately or simultaneously against the blanket cylinder 4 which, then, will form at the same time an impression cylinder for the blanket cylinders 6 and 12. The coupling engagements are provided with customary acceleration and synchronization devices which, by themselves, are well known in the industry; one such device is described, for example, in the referenced U.S. Pat. No. 4,346,656. Furthermore, the eccenter bushings on which the respective shaft ends of the various cylinders are retained in suitable side walls have been omitted from the drawing, since they can be of any suitable and well known construction.

The plate cylinders 3, 10, 16 of the three printing couples are axially shiftable in order to permit adjustment of lateral register. Such axial shift of the shafts of the plate cylinders, and hence of the shaft stubs or ends thereof, are well known and, again, have been omitted from the drawings for clarity. The devices and apparatus units to provide for axial shift of the plate cylinders are usually located at the side opposite the drive side of the machine, and, with respect to FIG. 2, would be located at the right side. Such axial shift arrangements for the cylinders by themselves are well known in the industry.

In accordance with a feature of the invention, the circumferential register of the plate cylinders 10 and 16 of the respectively selectively engageable printing couples is obtained by locating the blanket cylinders 6 and 12 in bushings or bearings so arranged that they can be axially shifted. Since the gears 7 and 8, as well as 13 and 14, respectively, located on the shaft of the blanket cylinders 6 and 12, respectively, also then will shift axially, shift of the gears 7 and 13 with respect to the engaged gear 5, on blanket cylinder 4 and coupled through gear 2 to the drive gear 1, will result in rotation of the blanket cylinders 6 and 12 with respect to the gear 5. This is due to the spiral or inclined gearing of the respective gears 5, 7, 8, 13, 14. At the engagement points of the gear 8 with the gear 11 of blanket cylinder 10 or, respectively, of the gear 14 with gear 17 of the plate cylinder 16, axial shift of the blanket cylinders 6, 12, respectively, will also cause rotation of the gears 11 and 17 respectively. Due to the opposite angles of inclination of the spiral gears 7 with respect to the gear 8, and of the gear 13 with respect to the gear 14, respectively, axial shift of the blanket cylinders will cause addition of the resulting change in rotary angle, so that the plate cylinders 10, 16, respectively, will rotate by twice the angle about which the respective gears 7, 8 and 13, 14 are shifted. Apparatus for axially shifting the blanket cylinders 6 and 12, since it is well known, is merely schematically shown in FIG. 2 by arrows 6' and 12'.

The circumferential register adjustment of the plate cylinder by axial shifting of the associated blanket cylinder can be carried out independently of the condition of engagement or disengagement of the associated clutches 9, 15. If the shift is carried out with the clutch disengaged, it will become effective only when the fixed point clutch 9, 15, respectively, connects the respective gears 7 and 13 with the shaft of the associated blanket cylinders 6,12 at the predetermined positions selected therefor.

Various changes and modifications may be made, and the invention is not limited to the cylinder configuration described in connection with FIGS. 1 and 2, utilizing six cylinders with two selectively engageable printing couples. For example, the invention can be used with a nine-cylinder complete satellite printing system having respectively alternate engagement of two printing systems and permitting change of printing plates during operation of the machine, and when printing in dual subject matter prime printing, also referred to as 2/0 printing, to good advantage. FIG. 1 also shows guidance of a substrate web W through the printing machine, guided by suitable rollers, which can be of any desired configuration, as well known in the art. Engagement and disengagement of the respective printing couples 6, 10 and 12, 16 with the blanket cylinder 4, which forms an impression cylinder, is shown schematically by the double arrow A.

We claim:

1. Rotary offset printing machine system for printing on a substrate web (W) having first, second and third printing systems, said first, second and third printing system each having first, second and third plate cylinders (3, 10, 16) and associated with first, second and third blanket cylinders (4, 6, 12) to form first, second and third printing couples (3, 4; 10, 6; 16, 12) therewith, said system comprising the combination of a main spiral drive gear (1) transmitting rotational energy to said printing systems;

a plurality of spiral gears forming first (2), second (5), third (7), fourth (8), fifth (11), sixth (13), seventh (14) and eighth (17) spiral gears, in continuously meshing engagement for driving said cylinders, a first plate cylinder (3) of the first printing couple (3, 4) being rotationally continuously connected to the first (2) spiral gear;

a first blanket cylinder (4) of the first printing couple (3, 4) being rotationally continously connected to the second (5) spiral gear, said first and second spiral gears being in continuous meshing engagement, said main spiral drive gear (1) being coupled in continuous meshing engagement to one of said first and second spiral gears (2, 5);

the third (7) and fourth (8) spiral gears having oppositely directed spiral inclinations:

the sixth (13) and seventh (14) spiral gears having oppositely directed spiral inclinations:

the third (7) and sixth (13) spiral gears being in meshing engagement with the second spiral gear (5);

first clutch means (9) selectively coupling or disconnecting the third spiral gear (7) with, or form driving engagement with the second blanket cylinder (6) of the second printing couple (10, 6);

a second clutch means (15) selectively coupling or disconnecting the sixth spiral gear (13) with or from driving engagement with the third blanket cylinder (12) of the third printing couple (16, 12);

the fourth spiral gear (8) being securely rotationally coupled to the second blanket cylinder (6);

the sixth spiral gear (13) being securely rotationally coupled to the third blanket cylinder (12);

the fifth spiral gear (11) being securly rotationally coupled to the second plate cylinder (10) of the second printing couple (10, 6);

the eighth spiral gear (17) being securely rotationally coupled to the third plate cylinder (16) of the third printing couple (12, 16);

and means (6', 12') for axially shifting at least one of the second and third blanket cylinders (6, 12) of the second and third printing couples to thereby shift the circumferential register of the respective second or third plate cylinders (10, 16) with which the respective blanket cylinder is associated.

2. The printing machine system of claim 1, wherein the web (W) is guided about the first blanket cylinder (4) and between said first blanket cylinder (4) and the second and third blanket cylinders (6, 12) for printing subject matter for prime printing by at least one of said second and third blanket cylinders, said first blanket cylinder (4) forming an impression cylinder.

3. The printing machine system of claim 1, wherein the web (W) is guided about the first blanket cylinder (4), said first blanket cylinder being in printing image transfer with the first plate cylinder (3), said web being further guided between said first blanket cylinder (4) and said second and third blanket cylinders (6, 12) for printing subject matter in prime and verso print on said substrate web.

4. The printing machine system of claim 1, wherein said main drive gear (1) is coupled to the first spiral gear (2).

5. The printing machine system of claim 1, wherein said first clutch means (9) and said second clutch means (15) are simultaneously engageable to couple the third spiral gear (7) for driving engagement with the second blanket cylinder (6) and to couple the sixth spiral gear (13) for driving engagement with the third blanket cylinder (12) for simultaneous printing by said second and third printing couples (10, 6; 16, 12) on said substrate web (W).

6. The printing machine system of claim 1, further including shaft extensions coupled to said second and third blanket cylinders (6, 12);

and wherein the first and second clutch means (9, 15) are located at free ends of the respective shaft extensions projecting from the respective second and third blanket cylinders.

7. The printing machine system of claim 1, wherein said first and second clutch means (9, 15) are fixed position engagement clutches, said first clutch means (9) providing for precise relative circumferential position of the third spiral gear (7) in relation to the second blanket cylinder (6) of the second printing couple (10, 6) upon coupling of the third spiral gear (7) to the second blanket cylinder (6) by said first clutch means, and said second clutch means (15) providing for precise relative circumferential position of the sixth spiral gear (13) in relation to the third blanket cylinder (12) of the third printing couple (16, 12) upon coupling of the sixth spiral gear (13) to the third blanket cylinder (12) by said second clutch means (15).

8. The printing machine system of claim 2, wherein said first and second clutch means (9, 15) are fixed position engagement clutches, said first clutch means (9) providing for precise relative circumferential position of the third spiral gear (7) in relation to the second blanket cylinder (6) of the second printing couple (10, 6) upon coupling of the third spiral gear (7) to the second blanket cylinder (6) by said first clutch means, and said second clutch means (15) providing for precise relative circumferential position of the sixth spiral gear (13) in relation to the third blanket cylinder (12) of the third printing couple (16, 12) upon coupling of the sixth spiral gear (13) to the third blanket cylinder (12) by said second clutch means (15).

9. The printing machine system of claim 3, wherein said first and second clutch means (9, 15) are fixed position engagement clutches, said first clutch means (9) providing for precise relative circumferential position of the third spiral gear (7) in relation to the second blanket cylinder (6) of the second printing couple (10, 6) upon coupling of the third spiral gear (7) to the second blanket cylinder (6) by said first clutch means, and said second clutch means (15) providing for precise relative circumferential position of the sixth spiral gear (13) in relation to the third blanket cylinder (12) of the third printing couple (16, 12) upon coupling of the sixth spiral gear (13) to the third blanket cylinder (12) by said second clutch means (15).

10. The printing machine system of claim 5, wherein said first and second clutch means (9, 15) are fixed position engagement clutches, said first clutch means (9) providing for precise relative circumferential position of the third spiral gear (7) in relation to the second blanket cylinder (6) of the second printing couple (10, 6) upon coupling of the third spiral gear (7) to the second blanket cylinder (6) by said first clutch means, and said second clutch means (15) providing for precise relative circumferential position of the sixth spiral gear (13) in relation to the third blanket cylinder (12) of the third printing couple (16, 12) upon coupling of the sixth spiral gear (13) to the third blanket cylinder (12) by said second clutch means (15).

11. The printing machine system of claim 6, wherein said first and second clutch means (9, 15) are fixed position engagement clutches, said first clutch means (9) providing for precise relative circumferential position of the third spiral gear (7) in relation to the second blanket cylinder (6) of the second printing couple (10, 6) upon coupling of the third spiral gear (7) to the second blanket cylinder (6) by said first clutch means, and said second clutch means (15) providing for precise relative circumferential position of the sixth spiral gear (13) in relation to the third blanket cylinder (12) of the third printing couple (16, 12) upon coupling of the sixth spiral gear (13) to the third blanket cylinder (12) by said second clutch means (15).

* * * * *